United States Patent [19]

Eberle

[11] Patent Number: 4,716,280

[45] Date of Patent: Dec. 29, 1987

[54] PARTICLE COUNTING DEVICE

[75] Inventor: Ray Eberle, Champaign, Ill.

[73] Assignee: Illinois Foundation Seeds, Inc., Champaign, Ill.

[21] Appl. No.: 2,191

[22] Filed: Jan. 12, 1987

[51] Int. Cl.[4] ..... G06M 9/02

[52] U.S. Cl. ..... 235/98 C; 235/98 R; 221/7

[58] Field of Search ..... 235/98 R, 98 A, 98 B; 221/7, 8

[56] References Cited

U.S. PATENT DOCUMENTS

| | | | |
|---|---|---|---|
| 2,594,337 | 4/1952 | Noe | 235/98 R |
| 3,746,201 | 7/1973 | Burgess, Jr. | 221/7 |
| 4,013,192 | 3/1977 | Pillon | 221/7 |

*Primary Examiner*—B. R. Fuller

*Attorney, Agent, or Firm*—Kinzer, Plyer, Dorn, McEachran & Jambor

[57] ABSTRACT

A self-cleaning counting device for particles such as seeds includes a circular housing have a well pivotally mounted therein for receiving and holding particles from a supply hopper. A disk having a plurality of openings is mounted for rotation in the housing such that the openings move past an open side of the well. A vacuum is applied to the side of the disk opposite the well such that individual particles are partially drawn into the disk openings and are carried thereby to a counting station where the particles are counted. After counting, the vacuum is removed and the counted seeds are released to a discharge chute. When a count is completed, the well is pivotable to a cleanout position where excess uncounted particles are purged from the housing.

16 Claims, 4 Drawing Figures

PARTICLE COUNTING DEVICE

SUMMARY OF THE INVENTION

This invention is concerned with a particle counting device. It is particularly applicable to use in agricultural research for counting out a predetermined number of seeds from a pure source. However, while the counting device is particularly adapted for counting agricultural seeds, it could also be used to count particles of any relatively coarse granular material such as, for example, pharmaceuticals.

When using a counting machine in agricultural research, it is imperative that all seeds are cleaned out of the machine at the end of a run to avoid contamination of a subsequent source of seeds. In the past, this has been a time-consuming procedure. Some prior art machines require manual cleaning with a specially designed vacuum cleaner. Others have such a long seed path that restarting an empty machine involves a significant delay. The present invention overcomes these drawbacks.

A primary object of the invention is a counting device which is self-cleaning.

Another object of the invention is a counting device capable of counting an entire supply of particles, down to and including the last particle in the device.

A further object of the invention is a counting device which has a particle handling mechanism which allows accurate counting of particles at a high rate.

These and other objects are realized by a counting device having a housing and a particle supply means for introducing uncounted particles into the housing. The particles are directed to a well which is pivotally mounted in the housing. In its normal position, the well receives and holds uncounted particles from the supply means. When the count is finished, the well is pivotable to a cleanout position, wherein uncounted particles fall out of the well and out of the housing. Transferring means are provided in the housing for carrying individual particles from the well to a counting station where they are counted. The transferring means includes a rotating disk having a plurality of openings sized somewhat smaller than the particles to be counted. A vacuum is applied to the openings such that individual particles are drawn partially into an opening and held there while the disk rotates, thereby carrying the particles to a counting station. Once the particles are counted, the vacuum is released and the particles are directed out of the counting device by a discharge chute.

DETAILED DESCRIPTION OF THE INVENTION

Figure 1:
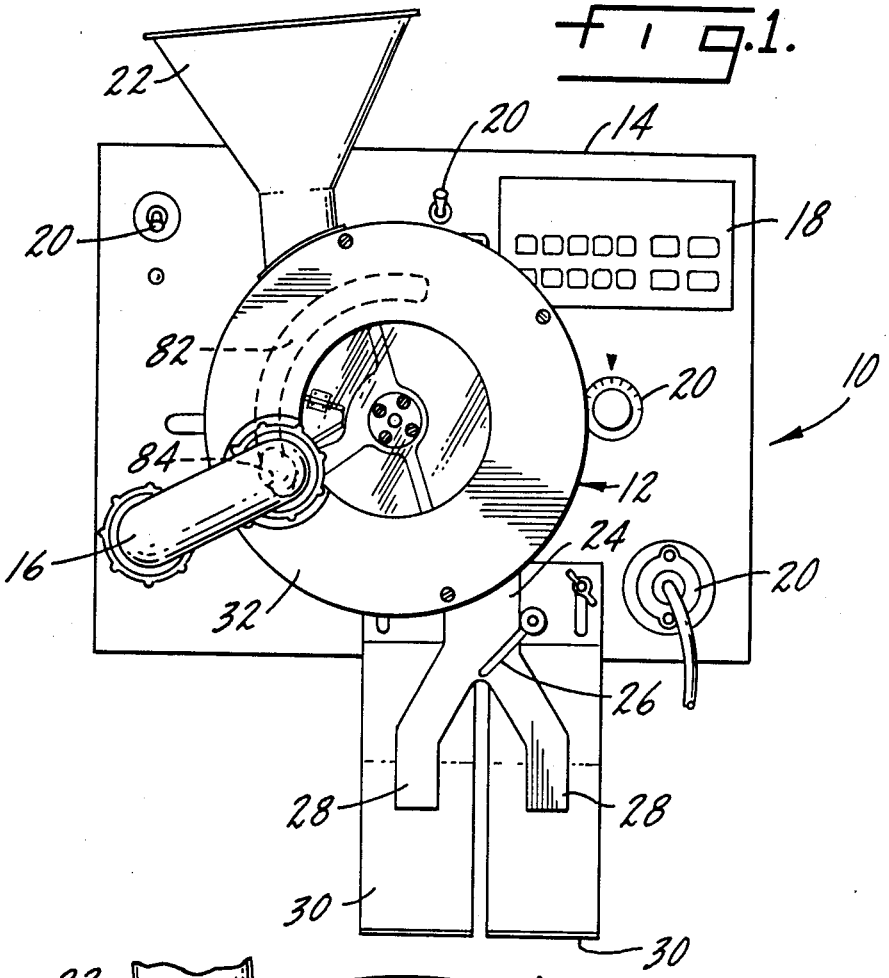
FIG. 1 is a front elevation view of the counting device.

The counting device of the present invention is shown generally at 10 in FIG. 1. The counting device includes a counting head 12 fixedly attached to a case 14. The case contains the equipment for operating the counting head, such as a vacuum pump, disk drive motor and associated control and counting circuitry. This equipment is standard and is not specifically shown. The vacuum pump is connected to an elbow 16 which extends through the front of the case 14 and supplies the vacuum to the counting head 12. The front of the case 14 has a control panel and display 18, as well as switches and knobs for controlling the vacuum pump, disk drive motor and motor speed. These controls are shown at 20.

A supply means for introducing uncounted particles into the counting head includes the supply hopper 22. Discharge means for directing counted particles out of the counting head includes the chute 24. The discharge chute includes an internal baffle (not shown) which may be moved by a crank 26 to direct counted seeds to one of two outlets 28. Alternately, the baffle may be positioned by a solenoid which may be automatically controlled from the control panel 18 when a predetermined count is satisfied. This arrangement would permit transferring the discharged particles from one outlet to the other without slowing down the counting process. A pair of trays 30 extend from the case 14 to hold seed packets or similar containers receiving the counted particles.

The counting head 12 has three main parts; a housing, a cover connected to the housing and a disk which is rotatable between the housing and cover. The cover is shown in FIG. 1 at 32. It is mounted to the housing by screws or the like. Further details of the cover's construction will be described below.

Figure 2:
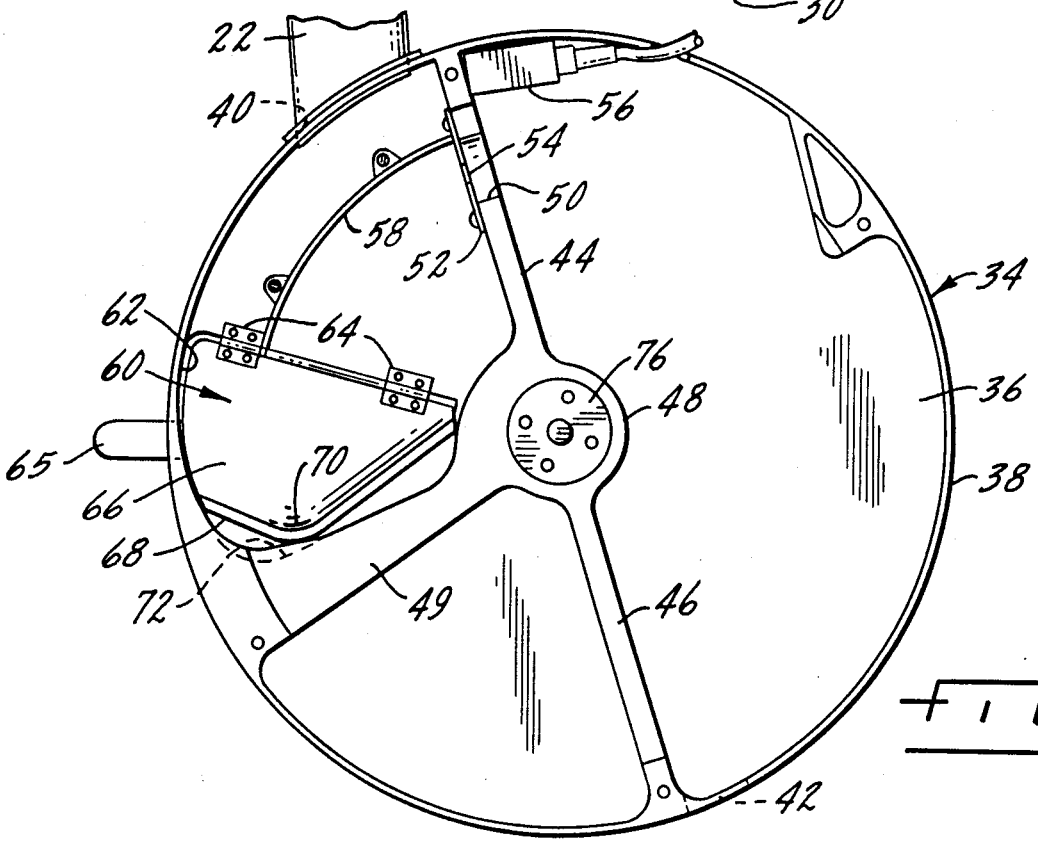
FIG. 2 is a front elevation view of the housing, with the disk and cover plate removed.

The housing is shown at 34 in FIG. 2. The housing is a generally circular casting having a back plate 36 and a rim 38 extending out of the plane of the back plate and forming a cavity in the housing. For reference purposes only, the cavity is about $\frac{7}{8}$ of an inch deep and the back plate is about 3/16 of an inch thick. The diameter of the housing is about $8\frac{3}{8}$ inches. The rim has an opening 40 communicating with the particle supply hopper 22 to permit uncounted particles to enter the housing cavity. Similarly, there is a discharge opening 42 in the lower side of the rim in communication with the discharge chute 24 to permit counted particles to exit the housing cavity.

A diametrical partition having an upper portion 44, a lower portion 46 and a central hub 48 divides the housing into two main sections. The first section, generally to the left of the partition 44, 46, 48 in FIG. 2, receives uncounted particles from the supply means through the opening 40. The second section, roughly to the right of the partition, receives the counted particles and directs them out the discharge opening 42. The first housing section is further divided by a radial cleanout baffle 49. It extends from the rim 38 to the hub 48 and divides the first housing section into upper and lower portions. The upper portion receives incoming particles. The lower portion is normally empty.

The upper partition 44 has a passage 50 which is large enough to permit passage of an individual particle of the largest size contemplated for use in the device. The passage is not large enough to permit more than one particle to pass at a time. If multiple particles are presented to the passage 50 at one time, the partition 44 will knock one or both of the multiple particles back into the first section of the housing. When smaller particles are being counted, an insert card 52 is placed adjacent the passage 50 in the upper partition 44. The insert card has an aperture 54 sized to permit passage of a single particle at a time. Together the insert card 52 and passage 50 form a gateway through which uncounted particles must pass to get from the first section of the housing to the second section. Immediately after passing through the gateway, individual particles are counted by a counting means 56. The counting means is preferably an electric eye or may alternatively be a proximity detector. In any event, its location immediately adjacent the gateway assures counting of individual particles as they enter the second section of the housing. Double or multiple particles cannot pass through the gateway, so inaccuracies due to flawed particle handling are prevented.

The first section of the housing has a wall 58 extending from the back plate 36 and forming a channel underneath the supply opening 40 to direct incoming particles to a well 60. The well is disposed in a cleanout opening 62 formed in the back plate 36. The well is pivotally connected to the back plate by hinges 64 and is movable by means of a tab 65. The well is pivotable between a first, normal position (shown in FIG. 2) and a second, cleanout position. In the first, normal position, the well generally closes the cleanout opening 62. Also, the well in its normal position receives and holds uncounted particles from the supply means as they fall down to the channel formed by the housing rim 38 and the wall 58. The well pivots outwardly through the cleanout opening 62 to the second, cleanout position, wherein uncounted particles are purged from the housing cavity. As seen in FIG. 2, the well pivots out the back of the housing.

The well itself comprises a back wall 66 which, when the well is in its normal position, is generally in the plane of the back plate 36. A shelf 68 protrudes from the back wall 66. The shelf is concave upwardly so that particles will be fed by gravity toward a central point. The upper surface of the shelf 68 is also sloped downwardly so that all particles will tend to funnel to a low point or nadir 70 of the well. This assures that the last particle in the well will fall to a point where it can be picked up and transferred to the counting station.

Directly beneath the well 60 is the cleanout baffle 49. The cleanout baffle 49 has an upper surface 72 which is sloped downwardly and to the rear of the housing so that when the well is moved to the cleanout position, any stray particles falling from the supply means, the well or the transferring means will be directed out of the cleanout opening 62.

Figure 3:
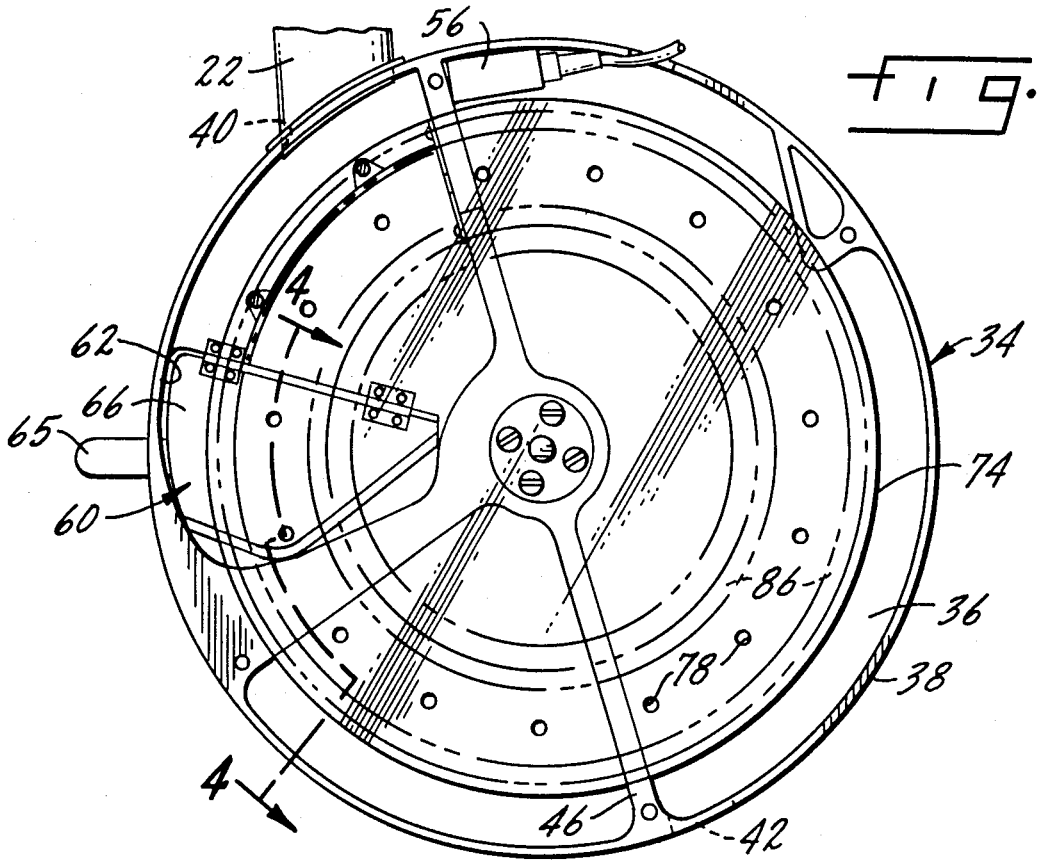
FIG. 3 is a front elevation view of the housing and disk.

Turning now to FIG. 3, the transferring means for carrying the particles from the well to the counting means is illustrated. The transferring means comprises a disk 74 which is rotated by shaft 76. The shaft extends through the hub 48 and is driven by the motor inside the casing of the machine. The disk is driven at a speed which permits a nominal counting rate of 1000 seeds per minute on soybeans. For reference purposes only, the disk is about 7 inches in diameter and $\frac{1}{8}$ inch to 3/16 inches thick. The disk is positioned so that it has a minimal clearance over the partitions 44, 46, the hub 48, the well 60 and the cleanout baffle 49. As can be seen in FIG. 3, the disk also covers a substantial portion of the open side of well 60.

The disk 74 has a plurality of openings 78 which are sized somewhat smaller than the particles being counted. It is important that the particles not fit all the way through the openings 78. The openings are located on a radius such that as the disk rotates the openings pass the nadir 70 of the well 60. A vacuum is applied to the side of the disk opposite the well 60, i.e., the vacuum is applied to the front of the disk as seen in FIG. 3. As a result of the vacuum, individual particles are drawn partially into the openings 78 as they rotate past the well. Particles are then carried through the gateway to the second section of the housing where they are counted by the counting means. It is contemplated that a separate disk will be provided for each type of particle to be counted, with openings 78 sized for that particular particle.

Figure 4:
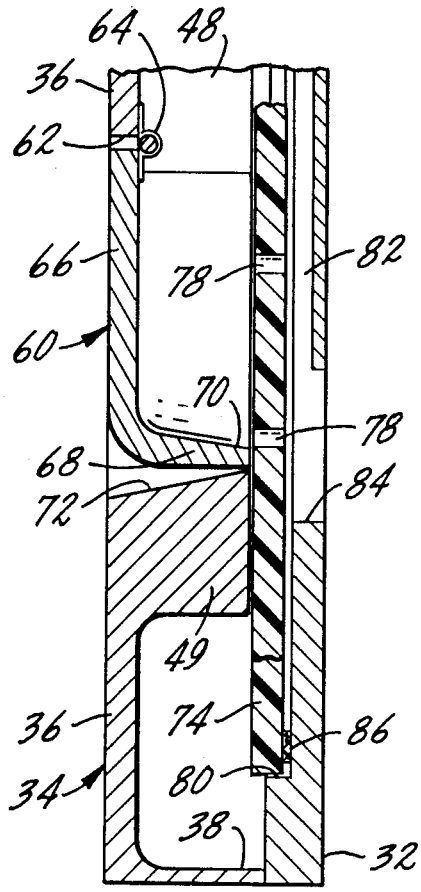
FIG. 4 is a section taken generally along line 4—4 of FIG. 3.

The means for applying the vacuum are best seen in FIG. 4. The cover plate 32 has a depression 80 into which the disk 74 fits. An arcuate vacuum chamber 82 is cut into the depression 80 of the cover plate. The vacuum chamber communicates with the elbow 16 through an opening 84 in the cover plate. The arc of the vacuum chamber 82 extends from approximately the nadir 70 of the well to the location of the counting means 56 and its radius is such that the chamber is always opposite the path described by the disk openings 78. The vacuum chamber is sealed between the disk 74 and cover plate 32 by a pair of circular seals, shown at 86, and by phantom lines in FIG. 3. The seals may be made of felt, cotton, teflon or other suitable material.

FIG. 4 also illustrates the shape of the well shelf 68 and the cleanout baffle 49. It will be noted that the shelf 68 slopes downwardly to the nadir 70. This condition, along with the concave shape of the shelf, funnels all of the particles to the nadir of the well which, as shown in FIG. 4, is directly adjacent the path of the openings 78 in the disk 74. This feature allows the last particle in the shelf to be picked up by the rotating disk and carried to the counting means.

When it is desired to clean out the counting head, the well 60 is pivoted out of the cleanout opening to its cleanout position. This dumps all uncounted particles in the well out the back of the counting head. Any stray particles falling from the supply means will contact the sloping surface 72 of the cleanout baffle 49 and thus are similarly directed out the back of the counting head. Any uncounted particles in transit from the well to the gateway will be dropped back out of the cleanout opening when the vacuum is released. In the second section of the housing, the lower partition 46 and the rim 38 direct all particles to the discharge opening 42. Since the discharge opening is located at the lowest point of the second section, all particles will fall out of the second section of the housing.

With regard to lower portion of the first housing section, i.e., between the cleanout baffle 49 and lower partition 46, ordinarily there will be no particles in that portion of the housing because of the close tolerance between the rotating disk 74 and the baffle 49. If, however, a stray particle should somehow become wedged past the disk into the portion below the cleanout baffle, it will simply remain there. This is because the vacuum is not applied until the openings 78 are opposite the well and, thus, stray particles in the lower portion of the first section will never be picked up by the disk. They will simply remain there until the cover plate and disk are removed.

The use, operation and function of the invention are as follows. Particles to be counted are placed in the hopper 22 and they fall through the opening 40, down the channel formed by the wall 58 and into the well 60, which is in its normal position. The vacuum is turned on and the drive motor turns the disk 74, moving the openings 78 past the nadir 70 of the well where individual particles are drawn partially into the openings 78. The disk carries individual particles through the aperture 54 and the passage 50 in the gateway to the counting means 56 where the particles are counted. The vacuum is released at this point and the particles fall through the second section of the housing and out the discharge opening 42 to the discharge shoot 24.

When a predetermined count is satisfied, there will ordinarily be particles left in the first section of the housing. In agricultural research, the self-cleaning feature of the invention becomes extremely important because of the need to prevent contamination of one entry with seeds from a previous entry. Also, in agricultural research it is likely that the number of sources or entries will be high, even though the number of envelopes being filled may be quite small. In other words, many different entries will be counted and it is important to keep seeds of different entries separated. This requirement is met by the self-cleaning feature of the present invention. When the well 60 is moved to its cleanout position, all seeds will fall out of the well and any stray seeds in the first section of the housing will likewise be directed out of the housing by the cleanout baffle 49.

Whereas a preferred form of the invention has been shown and described, it will be realized that alterations may be made thereto without departing from the scope of the following claims.

I claim:

1. A counting device for counting particles of granular material, comprising:

a housing having at least one surface defining at least a partial enclosure;

particle supply means associated with the housing for introducing uncounted particles into the housing;

counting means mounted on the housing surface for counting individual particles;

a well having at least one wall pivotally mounted to the housing surface for rotation between a first normal position wherein the well receives and holds uncounted particles from the supply means and a second cleanout position wherein uncounted particles are purged from the housing;

transferring means mounted in the housing enclosure for carrying individual particles from the well to the counting means where they are counted and then released; and discharge means associated with the housing for directing counted particles out of the counting device.

2. The counting device of claim 1 wherein the housing surface includes a cleanout opening, the well being pivotable out of said opening to the cleanout position.

3. The counting device of claim 2 wherein the well further comprises a shelf extending outwardly from the wall, the upper surface of the shelf sloping downwardly when the well is in its normal position.

4. The counting device of claim 3 wherein the shelf is concave upwardly.

5. The counting device of claim 4 wherein the housing includes a cleanout baffle located below the supply means and the well, the baffle presenting a sloping surface to stray particles falling from the supply means, well or transferring means and directing all such particles out the cleanout opening when the well is in the cleanout position.

6. The counting device of claim 1 wherein the housing includes a cleanout baffle located below the supply means and the well, the baffle presenting a sloping surface to stray particles falling from the supply means, well or transferring means and directing all such particles out of the counting device.

7. The counting device of claim 1 wherein the housing includes a partition having a gateway, the partition dividing the housing into first and second sections, the particle supply means introducing uncounted particles into the first section and the transferring means carrying individual particles through the gateway to the second section.

8. The counting device of claim 7 wherein the gateway is sized to permit passage of a single particle from the first to the second housing sections, the counting means being adjacent the gateway so that no particle can enter the second section without being counted, and the discharge means being connected to the second section.

9. The counting device of claim 1 wherein the transferring means comprises a rotatable disk mounted on a shaft in the housing adjacent an open side of the well, the disk having a plurality of openings therein, the openings being sized smaller than the particles and located such that as the disk rotates, the openings move past the well and the counting means, and means for applying a vacuum to the side of the disk opposite the well such that individual particles are drawn into engagement with an opening as the disk rotates and are thereby carried to the counting means.

10. The counting device of claim 9 wherein the means for applying a vacuum includes a cover plate mounted on the housing in sealing engagement with the side of the disk opposite the well, the cover plate having a vacuum chamber therein extending from opposite the well, along the path of the openings, to the counting means.

11. The counting means of claim 10 wherein the vacuum chamber ends at a point where particles have just been counted by the counting means, thereby releasing the particles to the discharge means.

12. A counting device for counting particles of granular material, comprising:

a housing having at least one surface defining at least a partial enclosure;

particle supply means associated with the housing for introducing uncounted particles into the housing;

counting means mounted on the housing surface for counting individual particles;

a well having at least one wall mounted to the housing surface in a position wherein the well receives and holds uncounted particles from the supply means;

a rotatable disk mounted on a shaft in the housing adjacent an open side of the well, the disk having a plurality of openings therein, the openings being sized smaller than the particles and located such that as the disk rotates, the openings move past the well and the counting means; and means for applying a vacuum to the side of the disk opposite the well such that individual particles are drawn into engagement with an opening as the disk rotates and are thereby carried to the counting means.

13. The counting device of claim 12 wherein the housing surface includes a cleanout opening and the well is pivotable out of said opening to empty the well of uncounted particles.

14. The counting device of claim 13 wherein the well further comprises a shelf extending outwardly from the wall, the upper surface of the shelf sloping downwardly when the well is in its normal position.

15. The counting device of claim 14 wherein the shelf is concave upwardly.

16. The counting device of claim 15 wherein the housing includes a cleanout baffle located below the supply means and the well, the baffle presenting a sloping surface to stray particles falling from the supply means, well or transferring means and directing all such particles out the cleanout opening when the well is in the cleanout position.

* * * * *